US008046154B2

(12) United States Patent
Yoon

(10) Patent No.: US 8,046,154 B2
(45) Date of Patent: Oct. 25, 2011

(54) METHOD FOR CONTROLLING CONTINUOUS VARIABLE VALVE TIMING APPARATUS

(75) Inventor: Maru Yoon, Hwaseong (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 749 days.

(21) Appl. No.: 12/177,354

(22) Filed: Jul. 22, 2008

(65) Prior Publication Data

US 2009/0157281 A1 Jun. 18, 2009

(30) Foreign Application Priority Data

Dec. 14, 2007 (KR) ..... 10-2007-0131574

(51) Int. Cl.
*F02D 41/26* (2006.01)

(52) U.S. Cl. ..... 701/105; 701/110; 123/90.11

(58) Field of Classification Search ..... 701/102, 701/103, 105, 106, 110, 111, 115; 123/90.11, 123/90.15–90.18; 454/2
See application file for complete search history.

(56) References Cited

U.S. PATENT DOCUMENTS 6,650,992 B2 * 11/2003 Jankovic et al. ..... 701/111
7,246,582 B2 * 7/2007 Miyakoshi ..... 123/90.17
2003/0093214 A1 * 5/2003 Jankovic et al. ..... 701/110
* cited by examiner

*Primary Examiner* — John T. Kwon
*Assistant Examiner* — Johnny Hoang
(74) *Attorney, Agent, or Firm* — Morgan, Lewis & Bockius LLP

(57) ABSTRACT

A method for controlling a continuous variable valve timing apparatus that can control a phase angle of a camshaft quickly and precisely according to an exemplary embodiment of the present invention may include: calculating a difference between a target phase angle and a current phase angle of a camshaft; determining whether the difference between the target phase angle and the current phase angle of the camshaft is larger than or equal to a predetermined value; calculating a base torque $T_b$ based on the target phase angle if the difference between the target phase angle and the current phase angle of the camshaft is larger than or equal to the predetermined value; calculating an effective torque $T_{eff}$ by modifying the base torque $T_b$ corresponding to engine speed and temperature of engine oil; and calculating an effective current $I_{eff}$ corresponding to the effective torque $T_{eff}$.

5 Claims, 3 Drawing Sheets

METHOD FOR CONTROLLING CONTINUOUS VARIABLE VALVE TIMING APPARATUS

CROSS-REFERENCE TO RELATED APPLICATION

This application claims priority to and the benefit of Korean Patent Application No. 10-2007-0131574 filed in the Korean Intellectual Property Office on Dec. 14, 2007, the entire contents of which are incorporated herein by reference.

BACKGROUND OF THE INVENTION (a) Field of the Invention

The present invention relates to an engine, more particularly, a method for controlling a continuous variable valve timing apparatus that variably controls opening and closing timing of intake and exhaust valves in an engine.

(b) Description of the Related Art

Generally, a continuous variable valve timing (CVVT) apparatus changes opening and closing timing of intake and exhaust valves by changing phase angle of a camshaft that controls opening and closing of the intake and exhaust valves, according to an engine speed and load state of a vehicle. If the CVVT apparatus is used in a vehicle, ignition timing of the air-fuel mixture can be controlled effectively. Therefore, exhaust gas and fuel consumption may be reduced, and engine performance may improve.

A conventional method for controlling a continuous variable valve timing apparatus is realized by a feedback control method. That is, the CVVT is controlled by applying a current according to a difference between a current phase angle of the camshaft and a target phase angle of the camshaft to an electric clutch for controlling phase angle of the camshaft every predetermined time interval.

However, according to the conventional method for controlling a continuous variable valve timing apparatus, there is a problem that control timing is delayed since the phase angle of the camshaft is controlled based on feedback control.

In addition, since the phase angle of the camshaft changes according to the temperature of engine oil and engine speed, it is difficult to precisely control valve timing.

The above information disclosed in this Background section is only for enhancement of understanding of the background of the invention and therefore it may contain information that does not form the prior art that is already known in this country to a person of ordinary skill in the art.

SUMMARY OF THE INVENTION

Embodiments of the present invention provide methods for controlling a continuous variable valve timing apparatus having advantages including controlling phase angle of a camshaft quickly and precisely.

A method for controlling a continuous variable valve timing apparatus according to an exemplary embodiment of the present invention may include: calculating a difference between a target phase angle and a current phase angle of a camshaft; determining whether the difference between the target phase angle and the current phase angle of the camshaft is larger than or equal to a predetermined value; calculating base torque $T_b$ based on the target phase angle if the difference between the target phase angle and the current phase angle of the camshaft is larger than or equal to the predetermined value; calculating effective torque $T_{eff}$ by modifying the base torque $T_b$ according to engine speed and temperature of engine oil; and calculating effective current $I_{eff}$ corresponding to the effective torque $T_{eff}$.

The calculation of the effective torque $T_{eff}$ may include: calculating a first modification constant $K_{rpm}$ according to the engine speed; calculating a second modification constant $K_T$ according to the temperature of the engine oil; calculating friction torque $T_f$ according to the temperature of the engine oil; and calculating the effective torque $T_{eff}$ based on the base torque $T_b$, the first modification constant $K_{rpm}$, the second modification constant $K_T$, and the friction torque $T_f$.

The effective torque $T_{eff}$ may be calculated from the equation $T_{eff}=T_b*K_{rpm}*K_T-T_f$.

The effective current $I_{eff}$ may be calculated from the equation $I_{eff}=T_{eff}/b$, wherein b indicates a proportional constant.

The base torque $T_b$ may be calculated from the equation J[$]$˙$$[|$]$˙AP̈[|$]$˙gv̈+Dθ̇+Kθ=$T_b$, wherein J indicates rotational inertia of the camshaft, D indicates a damping coefficient of the camshaft, K indicates a spring constant of the camshaft, θ indicates the target phase angle, and θ̇, [|$]$˙$$[|$]$˙AP̈[|$]$˙gv̈ indicate respectively first and secondary derivatives of the target phase angle.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
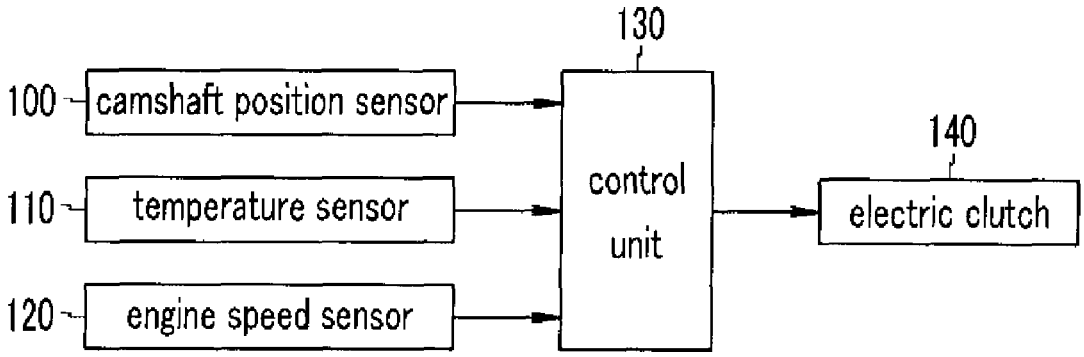
FIG. 1 is a schematic diagram showing a system that is applicable to a method for controlling a continuous variable valve timing apparatus according to an exemplary embodiment of the present invention.

In the figures, reference numbers refer to the same or equivalent parts of the present invention throughout the several figures of the drawing.

DETAILED DESCRIPTION OF THE EMBODIMENTS

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims FIG. 1 is a schematic diagram showing a system that is applicable to a method for controlling a continuous variable valve timing apparatus according to an exemplary embodiment of the present invention.

As shown in FIG. 1, a method for controlling a continuous variable valve timing apparatus according to an exemplary embodiment of the present invention includes a camshaft position sensor 100, a temperature sensor 110, an engine speed sensor 120, a control unit 130, and an electric clutch 140.

The camshaft position sensor 100 is mounted on a camshaft (not shown) of an engine, and it detects a phase angle of the camshaft and transmits a signal corresponding thereto to the control unit 130.

The temperature sensor 110 is mounted on the engine (not shown), and it detects the temperature of engine oil and transmits a signal corresponding thereto to the control unit 130.

The engine speed sensor 120 is mounted on a crankshaft (not shown), and it detects an engine speed based on a phase angle change of the crankshaft and transmits a signal corresponding thereto to the control unit 130.

The control unit 130 can be realized by one or more processors activated by a predetermined program, and the predetermined program can be programmed to perform each step of a method for controlling a continuous variable valve timing apparatus according to an embodiment of this invention.

The control unit 130 receives signals corresponding to the phase angle of the camshaft, the temperature of the engine oil, and the engine speed, respectively, from the respective sensors 100, 110, and 120. The control unit 130 calculates an effective electric current to apply to the clutch 140 based on the signals.

The electric clutch 140 controls the phase angle of the camshaft according to control of the control unit 130.

Hereinafter, a method for controlling a continuous variable valve timing apparatus according to an exemplary embodiment of the present invention will be described in detail.

Figure 2:
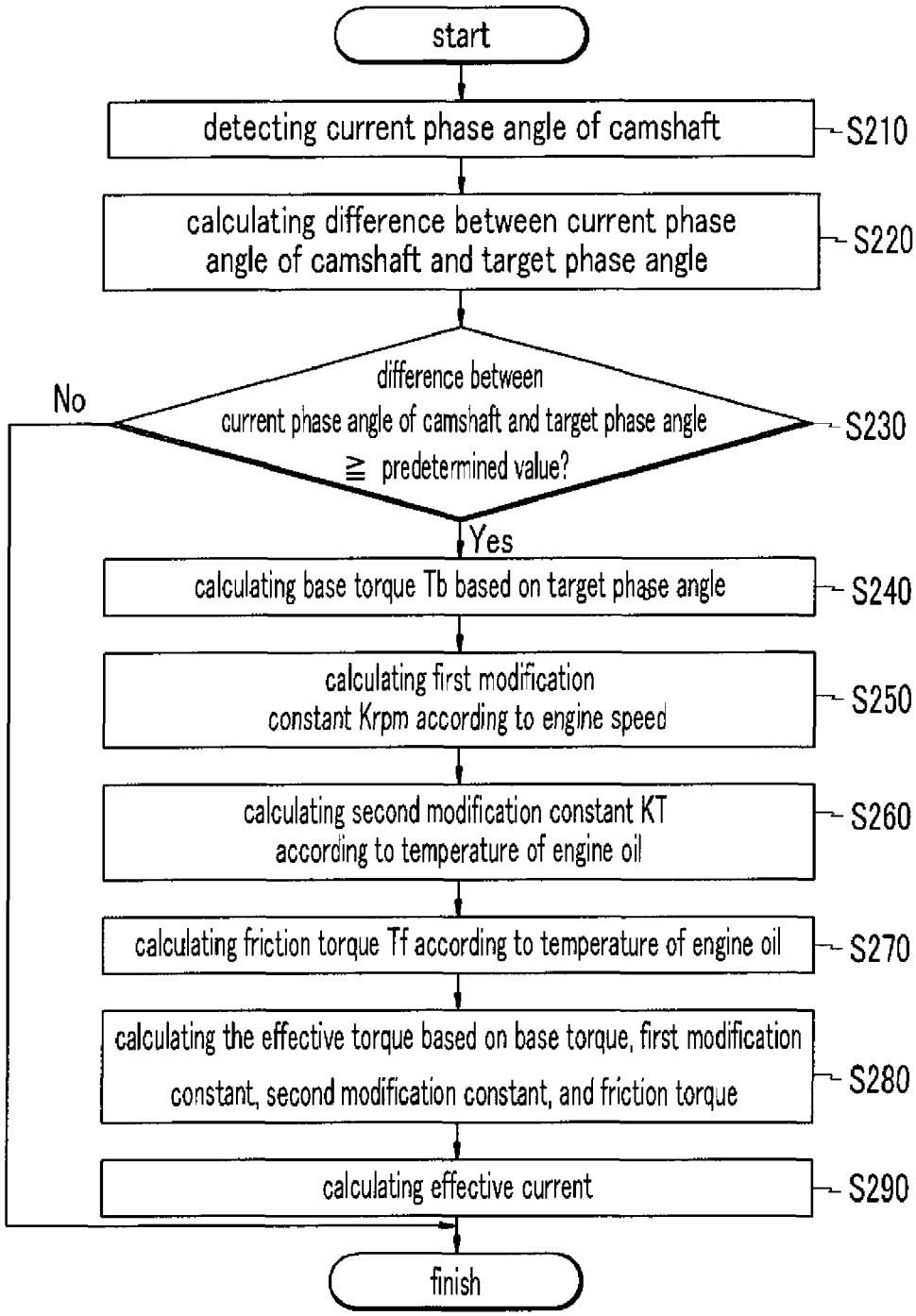
FIG. 2 is a flowchart of a method for controlling a continuous variable valve timing apparatus according to an exemplary embodiment of the present invention.

FIG. 2 is a flowchart of a method for controlling a continuous variable valve timing apparatus according to an exemplary embodiment of the present invention.

As shown in FIG. 2, when the camshaft position sensor 100 detects a current phase angle of the camshaft at step S210, the control unit 130 calculates a difference between the current phase angle of the camshaft and a target phase angle θ at step S220 and determines whether the difference between the current phase angle of the camshaft and the target phase angle θ is larger than or equal to a predetermined value at step S230.

If the difference between the current phase angle of the camshaft and the target phase angle θ is smaller than the predetermined value, the phase angle of the camshaft does not need to be controlled and the method for controlling a continuous variable valve timing apparatus according to the exemplary embodiment of the present invention is accordingly finished.

If the difference between the current phase angle of the camshaft and the target phase angle θ is larger than or equal to the predetermined value, a base torque $T_b$ is calculated based on the target phase angle θ from Equation 1 at step S240.

$$J[/\$]\$^{\cdot}\$\$[/\$]\$^{\cdot}A\dot{P}[/\$]\$^{\cdot}g\dot{v}+D\dot{\theta}+K\theta=T_b \quad \text{[Equation 1]}$$

Here, J indicates rotational inertia of the camshaft, D indicates a damping coefficient of the camshaft, K indicates a spring constant of the camshaft, θ indicates the target phase angle, and $\dot{\theta}$,[|$]$^{\cdot}$$$[|$]$ ^{\cdot}A$\dot{P}$[|$]$^{\cdot}g$\dot{v}$ respectively indicate first and secondary derivatives of the target phase angle. The rotational inertia, the damping coefficient, and the spring constant of the camshaft may be predetermined, the target phase angle may be detected, and the first and second derivatives of the target phase angle may be calculated by detecting the target phase angle for a predetermined interval.

After that, the control unit 130 calculates effective torque $T_{eff}$ by modifying the base torque $T_b$ according to the engine speed and the temperature of the engine oil.

Figure 3:
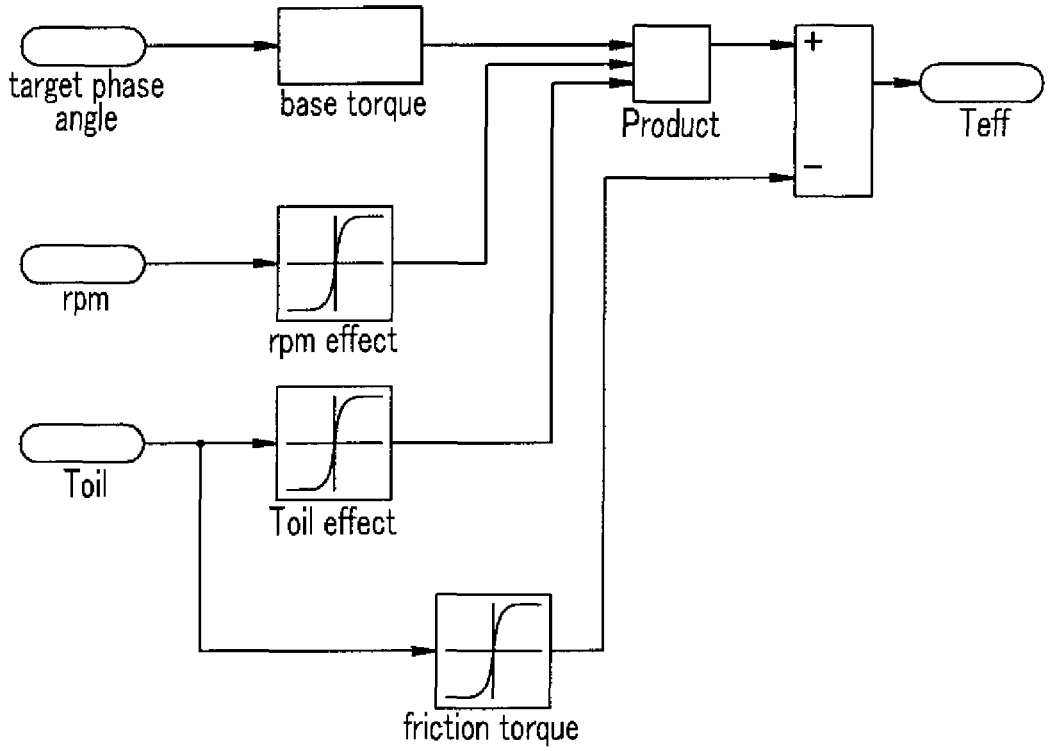
FIG. 3 is a block diagram showing processes for calculating effective torque in a method for controlling a continuous variable valve timing apparatus according to an exemplary embodiment of the present invention.

Referring to FIG. 3, the calculation of the effective torque $T_{eff}$ will be described in detail.

As shown in FIG. 3, the control unit 130 calculates a first modification constant $K_{rpm}$ according to the engine speed at step S250, and calculates a second modification constant $K_T$ according to the temperature of the engine oil at step S260. In addition, the control unit 130 calculates friction torque $T_f$ according to the temperature of the engine oil at step S270. The first modification constant $K_{rpm}$ according to the engine speed, the second modification constant $K_T$ according to the temperature of the engine oil, and the friction torque $T_f$ according to the temperature of the engine oil may be determined by performing many experiments, and may be stored in a map table in the control unit 130.

Then, the control unit 130 calculates the effective torque $T_{eff}$ based on the base torque $T_b$, the first modification constant $K_{rpm}$, the second modification constant $K_T$, and the friction torque $T_f$ at step S280. The effective torque $T_{eff}$ may be calculated from Equation 2.

$$T_{eff}=T_b*K_{rpm}*K_T-T_f \quad \text{[Equation 2]}$$

The control unit 130 then calculates effective current $I_{eff}$ according to the effective torque $T_{eff}$ at step S290. The effective current $I_{eff}$ may be calculated from Equation 3.

$$I_{eff}=T_{eff}/b, \quad \text{[Equation 3]}$$

where b indicates a proportional constant.

Then, the control unit 130 applies the effective current $I_{eff}$ to the electric clutch 140.

As described above, according to a method for controlling a continuous variable valve timing apparatus of the present invention, a continuous variable valve timing apparatus may be controlled quickly and precisely since effective current is calculated considering engine speed and temperature of engine oil, and an electric clutch is controlled according to the effective current.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method for controlling a continuous variable valve timing apparatus, comprising:

calculating a difference between a target phase angle and a current phase angle of a camshaft;

determining whether the difference between the target phase angle and the current phase angle of the camshaft is larger than or equal to a predetermined value;

calculating a base torque $T_b$ based on the target phase angle if the difference between the target phase angle and the current phase angle of the camshaft is larger than or equal to the predetermined value;

calculating an effective torque $T_{eff}$ by modifying the base torque $T_b$ according to engine speed and temperature of engine oil; and calculating an effective current $I_{eff}$ corresponding to the effective torque $T_{eff}$.

2. The method of claim 1, wherein the calculation of the effective torque $T_{eff}$ comprises:

calculating a first modification constant $K_{rpm}$ according to the engine speed;

calculating a second modification constant $K_T$ according to the temperature of the engine oil;

calculating a friction torque $T_f$ according to the temperature of the engine oil; and calculating the effective torque $T_{eff}$ based on the base torque $T_b$, the first modification constant $K_{rpm}$, the second modification constant $K_T$, and the friction torque $T_f$.

3. The method of claim 2, wherein the effective torque $T_{eff}$ is calculated from the equation $T_{eff}=T_b*K_{rpm}*K_T-T_f$.

4. The method of claim 3, wherein the effective current $I_{eff}$ is calculated from the equation $I_{eff}=T_{eff}/b$, wherein b indicates a proportional constant.

5. The method of claim 1, wherein the base torque $T_b$ is calculated from the equation J[|$]$˙$$[|$]$˙AP̈[|$]$˙gv̇+Dθ̇+Kθ=$T_b$, wherein J indicates rotational inertia of the camshaft, D indicates a damping coefficient of the camshaft, K indicates a spring constant of the camshaft, θ indicates the target phase angle, and θ̇, [|$]$˙$$[|$]$˙AP̈[|$]$˙gv̇ respectively indicate first and secondary derivatives of the target phase angle.

* * * * *